United States Patent [19]

Walther

[11] Patent Number: 4,771,771

[45] Date of Patent: Sep. 20, 1988

[54] GAS MASK HAVING A PROTECTIVE HOOD

[75] Inventor: Hans-Joachim Walther, Lubeck, Fed. Rep. of Germany

[73] Assignee: Drägerwerk AG, Fed. Rep. of Germany

[21] Appl. No.: 933,277

[22] Filed: Nov. 17, 1986

Related U.S. Application Data

[63] Continuation of Ser. No. 689,653, Jan. 8, 1985, abandoned.

[30] Foreign Application Priority Data

Jan. 10, 1984 [DE] Fed. Rep. of Germany ..... 3400505

[51] Int. Cl.[4] ..... A62B 7/10

[52] U.S. Cl. ..... 128/201.25; 128/202.27; 128/206.17

[58] Field of Search ..... 128/201.13, 201.23, 128/201.25, 205.25, 205.27, 205.29, 206.12, 206.13–206.17, 202.13, 202.27; 206/222, 663

[56] References Cited

U.S. PATENT DOCUMENTS

| | | | |
|---|---|---|---|
| 2,534,720 | 12/1950 | Loose | 128/206.17 |
| 2,591,953 | 4/1952 | MacLean | 128/206.16 |
| 3,152,588 | 10/1964 | Rogowski | 128/206.12 |
| 4,212,846 | 7/1980 | Wise | 128/205.28 |
| 4,430,995 | 2/1984 | Hilton | 128/205.12 |
| 4,467,795 | 8/1984 | Eckstein | 128/206.17 |
| 4,473,072 | 9/1984 | Walther | 128/202.13 |
| 4,501,272 | 2/1985 | Shigematsu | 128/206.17 |

FOREIGN PATENT DOCUMENTS

| | | | |
|---|---|---|---|
| 650830 | 10/1967 | Fed. Rep. of Germany | 128/205.28 |
| 3236028 | 3/1984 | Fed. Rep. of Germany | 128/206.12 |

*Primary Examiner*—Edward M. Coven
*Assistant Examiner*—K. M. Reichle
*Attorney, Agent, or Firm*—McGlew and Tuttle

[57] ABSTRACT

Gas masks each with a protective hood according to the invention are used as rescue equipment, e.g. escape equipment. For this purpose, they must be available when needed in a fail-safe condition and then untrained persons must be able to apply and use them. The gas mask has in its protective hood portion a breathing attachment in form of a half mask. On the outside, the breathing attachment supports a plug-in frame which is open at opposite sides or ends and accommodates a breathing filter inserted therein through one of the open ends or sides. Respiration takes place through the inlet walls of the frame and the filter. The used-up breathing filter is replaced by inserting a replacement filter. The simple insertion or replacement of the breathing filter makes training of untrained persons possible by using training filters.

3 Claims, 2 Drawing Sheets

GAS MASK HAVING A PROTECTIVE HOOD

This application is a continuation of application Ser. No. 689,653, filed Jan. 8, 1985, now abandoned.

FIELD AND BACKGROUND OF THE INVENTION

This invention relates in general to breathing devices and in particular to a new and useful gas mask having a protective hood and a respiratory gas inlet in the form of a cassette for receiving a breathing filter cartridge.

A similar gas mask with a protective hood is already known from German OS No. 32 06 484. Gas masks with protective hoods according to the invention are used as rescue equipment. For this purpose, they must be available when needed in fail-safe condition; untrained persons must be able to apply them; and these users must be able to replace breathing filters used up after protracted use.

A gas mask with protective hood has become known from German OS No. 32 06 484, U.S. Pat. No. 4,473,072, which is intended as filter equipment for escape purposes and includes a half mask. While in storage, the filter is tightly wrapped in a packaging bag for protection against environmental influences and, together with it, tied firmly up a strap in the halfmask and the protective hood enclosing it. The ends of the packaging bag are perforated by tear lines and connected to the folded protective hood so that when using the equipment, the packaging bag is opened on both sides at the same time as the protective hood is unfolded. Replacing the used-up filter by untrained persons, either to extend the time of serviceability during storage or after training exercises or while being used to prolong the equipment's usefulness is not possible because of the complicated strap fastening.

German Pat. No. 650,830 describes an oxygen mask in which a cartridge giving off oxygen and binding carbon dioxide can be replaced while using the mask. The mask has an attachment, into which a tubular container is screwed by means of a threaded nipple. The tubular container is open at both ends, and its jacket has mutually opposite openings. The one opening establishes through the threaded nipple the connection to the mask interior while the other opening leads to the exhaling tube and through it to the breathing bag. The cartridge, to be inserted from the side into the tubular container, has a jacket with openings coinciding with the openings in the container. When the cartridge is used up, it can be replaced by an insertable cartridge while the gas mask is in use. The patent describes an oxygen mask of very large, and due to its cylindrical shape, also unwieldy design in practice, however, the filter replacement idea could be adapted in an expedient manner.

SUMMARY OF THE INVENTION

The invention provides an improved gas mask with a protective hood which can be readily applied by untrained persons in case of catastrophy, and in which the breathing filter can easily be inserted by them or replaced after it is used up.

According to the invention, the breathing attachment has a plug-in frame which is open at opposite sides or ends, and in which the breathing filter, sealed by seals on both sides or ends and through which air is drawn, is accommodated.

In further development, the plug-in frame may support a dust filter on the outside upstream of the breathing filter.

The advantages achieved by the invention are in particular that, due to the simple insertion of the breathing filter into the plug-in frame, reliable protection is always provided without complications, even with untrained persons, particularly in cases of catastrophy. In case of unpredictably prolonged use, it is possible to replace the used-up breathing filter without interrupting the breathing protection. Training for emergency use can be conducted with training filters directly. It is good, if the user has an opportunity to feel the unavoidable breathing resistance once before.

Due to the fact that, in further development, the breathing filter has a cutting edge, by means of which it cuts open a packaging bag during the plug-in motion after the engagement to the plug-in frame of a retaining collar also included with the packaging bag, the process of insertion of the breathing filter into the plug-in frame is simultaneously combined with the removal of the breathing filter from its packaging bag.

Accordingly, it is an object of the invention to provide an improved gas mask which has a protective hood with an entrance fitting for the passage of respiratory gases which includes a chamber for a breathing gas filter which receives replaceable breathing gas filter gas cartridges.

A further object of the invention is to provide a breathing mask which has a breathing gas filter gas cartridge which is adapted to be carried in a sealed condition and which may be inserted into a respiratory gas inlet for the mask in a simple and easy manner which permits tearing of an enclosing package for the cartridge.

A further object of the invention is to provide a breathing mask which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
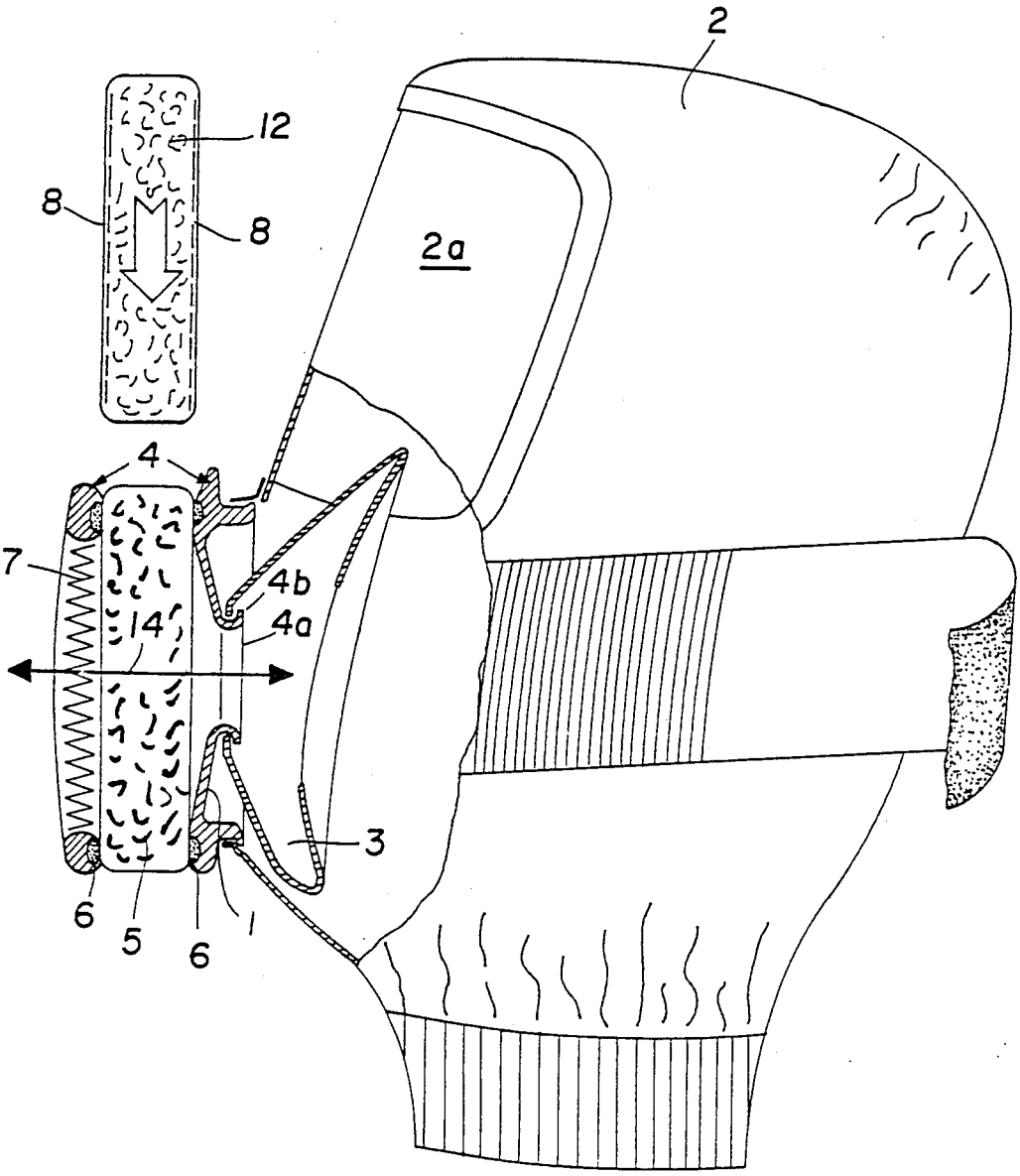
FIG. 1 is a side elevational view partly in section of a gas mask with protective hood and a replacement filter conducted in accordance with the invention.

Referring to the drawings in particular, the invention embodied therein comprises a protective hood adapted to cover the wearer's face which has a viewing window portion 2*a* and a respiratory gas inlet fitting or frame generally designated 4 which permits the movement of gases in the directions of the double arrow 14. In accordance with the invention, the inlet fitting 4 includes an inwardly converging wall portion 4*a* and, an annular lip 4*b* provided a seal with a half mask portion 3 which extends into the hood 2 and is adapted to fit over the wearer's nose and mouth. The frame 4 defines a respiratory gas passage 14 therethrough which passes through a breathing gas filter cartridge chamber 16 having a filter cartridge 5 therein which has a perforated wall on each side to facilitate the passage therethrough after it is removed from its protective casing. Advantageously, frame 4 also supports a dust filter 7 at its front or entrance end and includes resilient portions or seals 6 which bear tightly against the cartridge 5 to hold it in place.

The gas mask includes a breathing attachment 1, tightly inserted in a protective hood 2. Inside the mask, the breathing attachment 1 ends in a half mask 3 which engages around the wearer's nose and mouth. On the outside, it is designed like a cassette so as to form a plug-in frame 4 open on top and bottom, into which the desired breathing filter 5 is plugged. The seals 6 seal the breathing filter 5 tightly thereby preventing lateral air passage. The resilient seals 6 seal the cartridge for breathing filter 5 tightly in the frame 4. A dust filter 7 protects against environmental dust when breathing. Air is drawn through the breathing filter 5 through its perforated inlet walls 8 on each side.

The used-up breathing filter 5 is replaced by inserting a replacement filter 12 which heretofore was safely packaged.

Figure 2:
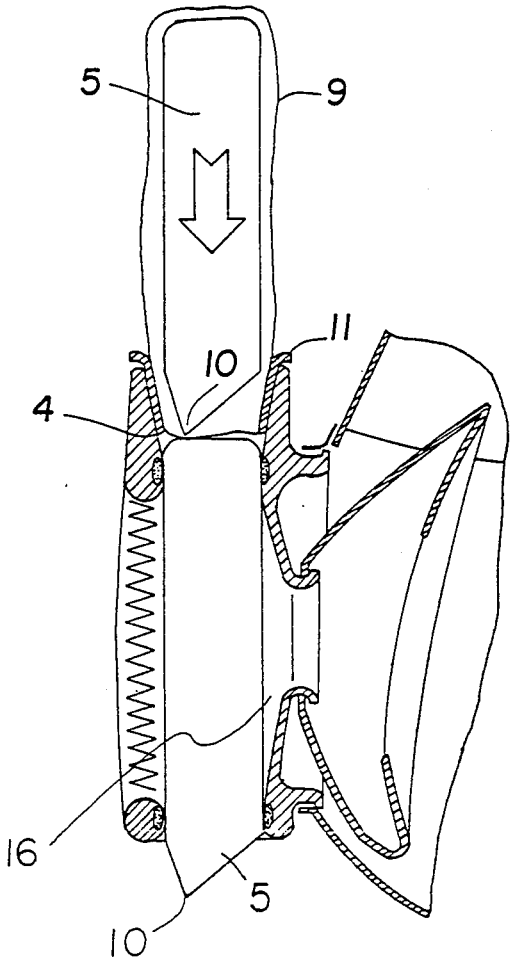
FIG. 2 is a partial sectional view of the same gas mask, except that the breathing filter has a cutting edge.

FIG. 2 shows another embodiment of the present invention which includes the breathing filter 5 in a packaging bag 9. The breathing filter 5 includes a cutting edge 10. In addition, the packaging bag 9 includes a retaining collar 11 fitting the plug-in frame 4. When inserting or replacing the used-up breathing filter 5, the cutting edge 10 cuts open the packaging bag 9 as the packaging bag 9 is held in place so that breathing filter may be passed out of the bag 9 into the frame 4.

While specific embodiments of the invention have been shown and described in detail to illustrate the application of the principles of the invention, it will be understood that the invention may be embodied otherwise without departing from such principles.

What is claimed is:

1. A mask construction, comprising: a head encompassing protective hood having a front portion adapted to overlie a wearer's face and having a viewing window adapted to overlie the wearer's eyes and a hood opening below the viewing window; a respiratory gas filter frame including a first front frame portion having a front inlet opening, a second rear frame portion connected to said hood, said second frame portion having an opening opposite to and aligned with said hood opening, said first frame portion and said second frame portion defining a chamber therebetween which extends through said filter frame and is sized to hold a filter cartridge; a filter cartridge adapted to be positioned in said cartridge chamber, held by said first and second frame portions and define with said first frame portion opening and said second frame portion opening a gas flow passage, resilient means connected to said first front frame portion and said second rear frame portion at the opposite ends of said cartridge chamber for sealing between the filter cartridge and the respiratory frame, said filter cartridge having a lower most edge defining a cutting edge; a sealed package containing said filter cartridge, said package including retaining collar means for engagement on said frame when said package is positioned with the cutting edge of said filter cartridge over an adjacent one of the ends of the cartridge chamber of said frame so as to retain the package at said one of the ends of the cartridge chamber when said cartridge is inserted into the cartridge chamber thereby, allowing replacement of a depleted filter cartridge already within the cartridge chamber with said filter cartridge while the gas mask is in use.

2. A gas mask according to claim 1 further comprising: a half-mask positioned within said hood and secured to said frame around said second frame portion opening.

3. A gas mask according to claim 1, wherein: the second frame portion is connected into said hood and said first frame portion include means to filter dust.

* * * * *